US006202899B1

(12) United States Patent
Lasserre et al.

(10) Patent No.: US 6,202,899 B1
(45) Date of Patent: Mar. 20, 2001

(54) DISPENSING HEAD FOR DISPENSING A PRODUCT AND PRESSURIZED DISPENSING UNIT EQUIPPED WITH THIS HEAD

(75) Inventors: Pierre-Andre Lasserre, Coubron; Marcel Sanchez, Aulnay-sous-Bois, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/257,038

(22) Filed: Feb. 25, 1999

(30) Foreign Application Priority Data

Feb. 25, 1998 (FR) ..... 98 02279

(51) Int. Cl.[7] ..... B65D 83/00
(52) U.S. Cl. ..... 222/402.1; 222/513
(58) Field of Search ..... 222/321.7, 402.1, 222/402.21, 402.23, 492, 494, 495, 496, 513, 514

(56) References Cited

U.S. PATENT DOCUMENTS

| | | | | |
|---|---|---|---|---|
| 3,357,604 | * | 12/1967 | Barker | 222/402.23 |
| 3,506,165 | * | 4/1970 | Beard | 222/402.23 |
| 3,696,977 | | 10/1972 | Davenport et al. | 222/561 |
| 3,920,165 | * | 11/1975 | Schultz | 222/402.23 |
| 4,437,592 | * | 3/1984 | Bon | 222/514 |
| 5,370,313 | | 12/1994 | Beard | 239/337 |
| 5,642,860 | | 7/1997 | Bush et al. | 239/333 |
| 5,950,848 | | 9/1999 | Baudin | 215/237 |

FOREIGN PATENT DOCUMENTS

| | | |
|---|---|---|
| 0 031123 | 7/1981 | (EP) . |
| 0244293 | 11/1987 | (EP) . |
| 2 684080 | 5/1993 | (FR) . |
| 40-24069 | 10/1965 | (JP) . |
| 6-12855 | 4/1994 | (JP) . |

* cited by examiner

*Primary Examiner*—Joseph A. Kaufman
(74) *Attorney, Agent, or Firm*—Oblon, Spivak, McClelland, Maier & Neustadt, P.C.

(57) ABSTRACT

A head (4) for dispensing a product under pressure includes a dispensing element (20) intended to be mounted on a pump or a valve (30) surmounting a product reservoir (2) and defining an outlet duct (34) for the product, opening to a dispensing orifice (22). A rigid or semi-rigid actuator (16) is capable of coming into engagement with the dispenser. A shut-off device (18) is integral with the actuator (16) and is capable, in response to a pressure exerted on the actuator, of moving from a first position in which it seals off the orifice (22) to a second position in which the orifice (22) is uncovered so as to allow the product to exit under pressure. The shut-off device (18) is formed of a material that is elastically deformable so that it can return to the first position by elastic return when the actuating pressure ceases.

14 Claims, 3 Drawing Sheets

DISPENSING HEAD FOR DISPENSING A PRODUCT AND PRESSURIZED DISPENSING UNIT EQUIPPED WITH THIS HEAD

BACKGROUND OF THE INVENTION

1. Field of the Invention

The present invention relates to a head for dispensing a product, especially a liquid or pasty product, this head being intended to be mounted on a reservoir pressurized particularly using a propellant gas, or manually by a pump or a piston. The invention also relates to a dispensing unit comprising such a reservoir filled with product, a dispensing valve and a dispensing head fitted with a push-button that can be actuated by a user with a view to ejecting a dose of product.

2. Discussion of the Background

The products likely to be thus dispensed from a dispensing unit of this type are, in particular, cosmetic products, hygiene products and maintenance products. In the field of body and hair care, there may, for example, be mentioned the packaging in pressurized cans of foaming shaving creams, self-foaming shaving gels, hair tints, cold hair reducing agents, shampoos, depilatory foams, sun-protection mousses and make up-removal mousses, particularly in self-foaming form.

In such dispensing units the ejected product travels along an ejection duct as far as an outlet orifice. Once the user has released the pressure exerted on the push-button, in practically all instances in the dispensing of products with the aforementioned consistency, the ejection duct does not have time to empty and as a result the product, in an amount which is all the greater if the outlet orifice is formed in an elongate application fitting, remains in the ejection duct.

The aforementioned products are of a nature such that, once dispensing is over, they tend to continue to come out of the ejection duct slowly (by foaming in the case of a foam or mousse, or by running in the case of liquid or viscous products), and this leads to soiling of the push-button or, in general, of the dispensing head or even of the user's hand.

It has already been proposed that this drawback be overcome by shutting off the outlet orifice when the container is in the position of rest, this orifice being uncovered only when the push-button is operated. Thus, Applicant's FR-A-2,617,809 proposes a dispensing unit for products with a viscous or pasty consistency or alternatively those which are dispensed in the form of foams or mousses from a container equipped with a moving push-button that has an ejection duct. According to this document, the ejection duct leads into a chamber delimited by a stationary part attached to the container and constituting, with the moving push-button, a dispensing head. The chamber opens to the outside via an outlet orifice. The moving push-button comprises a device capable of closing off the outlet orifice when the push-button is in the position of rest and of uncovering it when the button is actuated.

Trials conducted by the Applicant have shown that the sealing of the unit according to FR-A-2,617,809 leaves something to be desired. In particular, residual product was found in the space formed between the top of the container and the dispensing head. Furthermore, the moving push-button and the stationary part have to be mounted in two separate steps, and this mounting requires special tooling.

EP-A-0,031,123 describes a dispensing head that has an outlet duct, the end of which forms an outlet orifice, the duct being closed off in the position of rest by a central shutter.

The central shutter and the outlet duct are made of a rigid material, a thin region of the duct being provided at a point that is remote from the outlet orifice for allowing retraction of the duct and thus uncovering of the outlet orifice. This device has the drawback that the seal between the shutter and the outlet orifice leaves something to be desired, especially when the product coming out is an expanding foam or mousse. This is because, since the outlet orifice and the shutter are made of a rigid material by molding, the accuracy of these parts is not good enough to provide reliable sealing.

Furthermore, FR-A-2,684,080 discloses a dispensing head of the aforementioned type that has an outlet duct, the free end of which forms an internal rigid peripheral valve seat. In the position of rest, this peripheral seat cooperates with a central shutter made of a rigid material, connected to a moving actuating fitting capable of causing the shutter to retract and thus uncover the outlet orifice. This dispensing head, like that disclosed in EP-A 0031123, has problems with sealing. Furthermore, the shutter is difficult to fit, is complicated to mold, and on the industrial scale the whole assembly is difficult to mount.

SUMMARY OF THE INVENTION

It is an object of the present invention to provide a simplified dispensing head which is easier to mount on a reservoir as compared with the prior art.

According to a first aspect of the invention, the above and other objects are achieved by to a dispensing head for dispensing a product under pressure, comprising a dispensing member mountable on a pump or valve surmounting a reservoir containing the product and defining an outlet duct for the product, the outlet duct opening to at least one dispensing orifice; a substantially rigid actuating fitting movable in response to a pressure exerted on the actuating fitting from a first position to a second position, the actuating fitting being configured to come into engagement with the dispensing member during the movement of the actuating fitting from the first position to the second position in order to move the dispensing member from a closed position to a dispensing position in which the outlet duct is in communication with the reservoir; and a shut-off device movable with the actuating fitting from the first position in which the dispensing orifice is closed thereby to a second position in which the dispensing orifice is uncovered to allow the product to exit under pressure, wherein said shut-off device is constructed to elastically return to the first position when the actuating pressure ceases.

According to an advantageous embodiment, the substantially rigid actuating fitting can move axially over a travel that exceeds the travel of the dispensing member, the actuating fitting returning to the position of rest, partly as a result of the return force exerted by the elasticity of the pump or of the valve, and partly under the elastic-return force exerted by the shut-off device. For this purpose there may be a spring on which the pump or valve stem is mounted. The term "substantially rigid actuating fitting" is understood as meaning one whose structure, or the material used for it, is non-deformable under normal conditions of use.

A second aspect of the invention is a unit for packaging under pressure, comprising a reservoir for the product to be dispensed, fitted with a valve or with a pump, and equipped with a dispensing head according to the first aspect. In a preferred embodiment of the invention, this unit is fitted with a valve with an emerging stem in communication with the dispensing member, the product contained in the reservoir being pressurized by a propellant gas chosen from liquefied chloro-fluoro-alkanes or hydrocarbons, or nitrogen, compressed air, carbon dioxide, dimethyl ether or mixtures thereof.

By way of example, the product packaged in the reservoir is advantageously a self-foaming gel containing a foaming agent such as isopentane, a mousse or foam such as a shaving foam, a liquid foundation, a depilatory foam, or a hair-coloring product.

Advantageously the actuating fitting and the dispensing member are arranged in such a way that an actuating pressure first causes the shut-off device to move from the first position into the second position and then causes the outlet duct to be brought into communication with the reservoir, the dispensing member returning from the dispensing position into the closed position under the effect of a return force generated by the elasticity of the pump or of the valve.

Through this arrangement, any flow of residual product between the dispensing pump or valve and the dispensing orifice may be avoided instantly and reliably, to ensure that the unit remains clean after each use. In the position of rest the sealing occurs at the dispensing orifice. This sealing is guaranteed even if the product contains foaming agents such as isopentane which, at atmospheric pressure, tend to cause the product to expand for a time that may be as much as about ten minutes.

Furthermore, advantageously, the shut-off device, in the second position, provides sealing between the dispensing element and the actuating fitting. Through this arrangement, it is possible to avoid soiling of the mechanism, as this would then run the risk of impeding the mobility of the actuating fitting with respect to the dispensing member. According to an advantageous aspect of the invention, the shut-off device is formed of an elastomeric material, that is to say of a material, such as natural or synthetic rubbers, that is elastically compressible in its three dimensions.

For this purpose, advantageously, the actuating fitting has an annular portion surrounding the dispensing member and whose free end lies more or less in the vicinity of the at least one dispensing orifice, the shut-off device being formed of an annular member mounted inside the annular portion of the actuating fitting, the actuating fitting being mounted so that it can slide with respect to the dispensing member. Advantageously, this annular member defines a skirt having a free edge which, in the second position, provides sealing between the actuating fitting and the dispensing member.

In an advantageous embodiment, the actuating fitting and the shut-off device are produced by two-shot injection molding of a first and a second thermoplastic material which are physico-chemically compatible. Also, the first material may be, for example, a polyethylene or of a polypropylene, which are relatively rigid materials. In this case, the second material may be an elastomer chosen from the group of ethylene-propylene copolymers; poly(ether-block-amide)s; polyvinyls; ethylene-propylene-diene terpolymers (EPDM); styrene-butadiene block copolymers (SBS); styrene-ethylene-butadiene block copolymers (SEBS-SIS); thermoplastic polyurethanes; blends of polypropylene with one of the following elastomers:styrene-ethylene-butadiene block copolymers (SEBS-SIS), ethylene-propylene-diene terpolymers (EPDM), and styrene-butadiene block copolymers (SBS).

According to an advantageous embodiment, the at least one outlet orifice opens at right angles to the outlet duct, straight onto the internal face of the annular member. Thus, when product is being dispensed, the annular member acts as a breaker, avoiding accidental squirting and splashing of product, something which is advantageous when dispensing products which are very liquid or products which are highly pressurized.

Advantageously, the dispensing head comprises a part intended for fixing it onto the reservoir, for example an annular band, this part being integral with the actuating fitting via an articulation region, for example a film hinge.

BRIEF DESCRIPTION OF THE INVENTION

Apart from the arrangements explained hereinabove, the invention consists of a number of other arrangements which will be explained hereafter with regard to a non-limiting embodiment described with reference to the appended Figures, among which:

DETAILED DESCRIPTION OF THE PREFERRED EMBODIMENT

Figure 1:
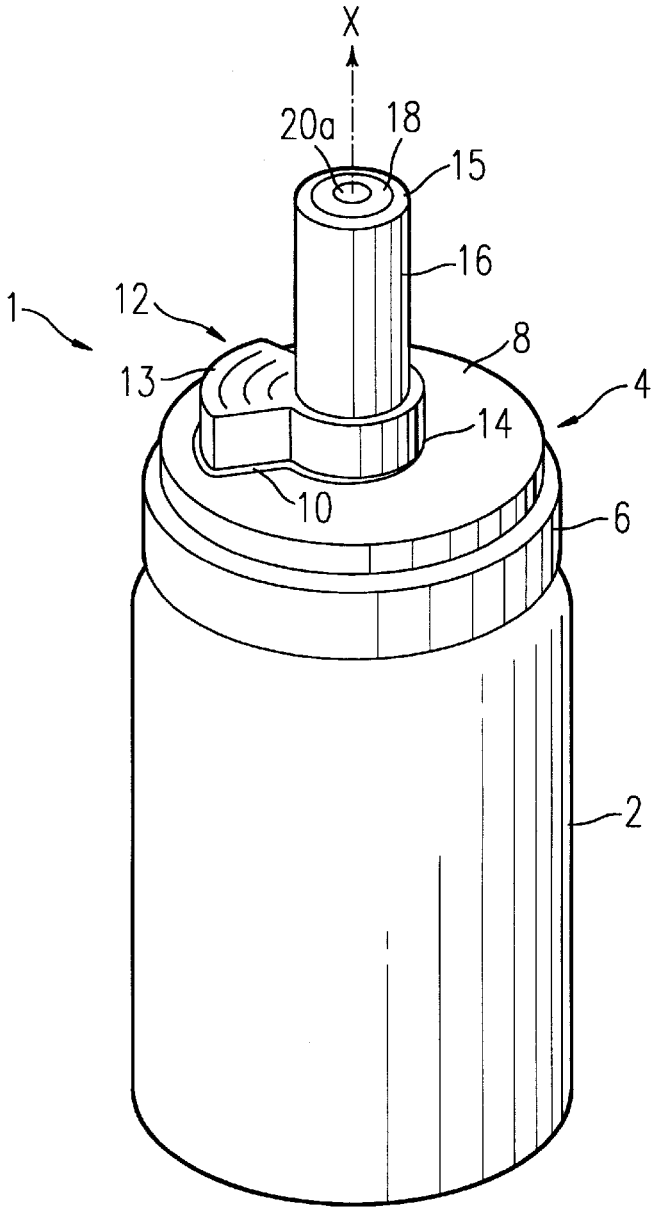
FIG. 1 depicts a view in perspective of a pressurized packaging unit fitted with a dispensing head, in accordance with one embodiment of the invention.
Figure 2:
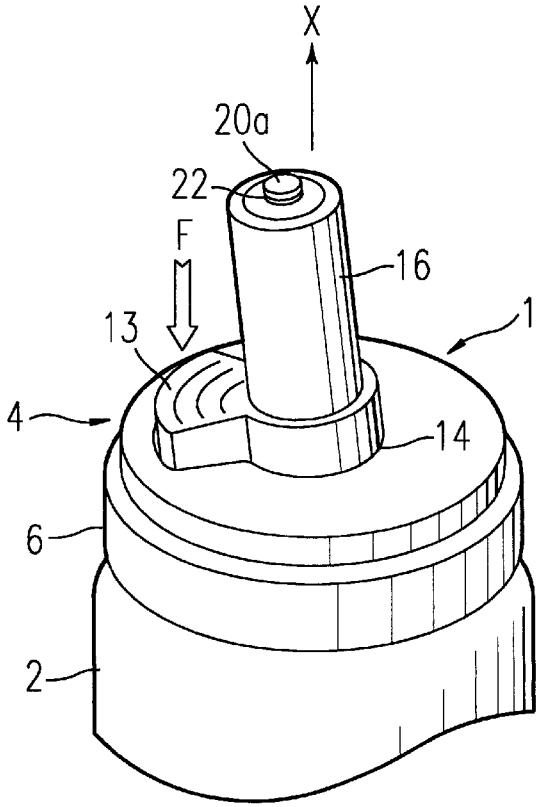
FIG. 2 depicts a part view in perspective of the unit of FIG. 1 during use.

FIGS. 1 and 2 show in perspective a dispensing unit 1 in accordance invention. This assembly, of axis X, consists of a reservoir 2 containing a liquid product, especially a foaming product, and a dispensing head 4 which is mounted on the reservoir via a cylindrical band 6. The band 6 carries a circular plate 8 in which is made a cut-out 10 delimiting a space in which there is placed a push-button 12 articulated so that it can pivot on the plate 8 by means of a film hinge 14. The push-button 12 has an actuating surface 13 located off-center with respect to the axis X and on which the user presses in order to dispense a dose of product. The push-button has a dispensing fitting 16 in the form of a cylindrical tube integral with the actuating surface 13. As shown in FIG. 1, when the unit is in the position of rest the axis of the fitting 16 is coincident with the axis X. The fitting 16 has a free end 15 inside which is placed an annular shut-off device 18. This shut-off device 18 is advantageously made of an elastomer material, such as an ethylene-propylene-diene terpolymer (EPDM). Such a material is marketed by the company MONSANTO under the trade name of Santoprene®. Inside the annular shut-off device is a dispensing member 20. In the position of rest, the dispensing member 20 does not protrude outwards from the annular shut-off device 18.

When the user presses on the actuating surface 13 of the push-button 12, by pivoting about the film hinge 14 the push-button is driven slightly into the space delimited by the cut-out 10. During this action, the fitting 16 and the shut-off device 18 retreat with respect to the dispensing member 20, thus uncovering the free end 22 of a dispensing duct.

Figure 3:
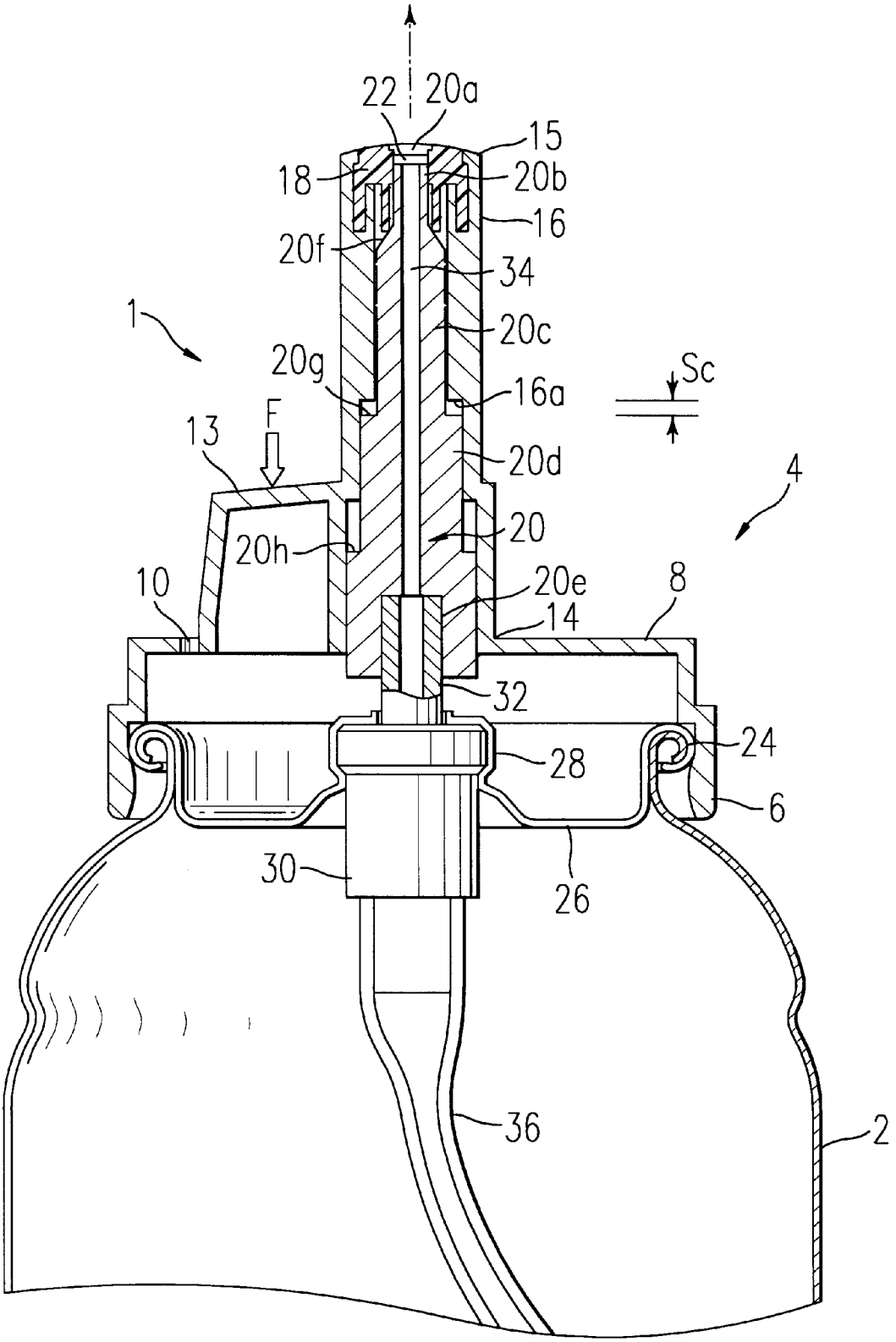
FIG. 3 shows an enlarged part view in longitudinal section of the unit of FIG. 1 in the position of rest.

FIG. 3 shows the dispensing head 4 of FIGS. 1 and 2, depicted in axial section. The head is mounted on the top of an aerosol container 2 made for example of aluminium and having a rolled neck 24 to which a valve-carrier dish 26 is fixed by crimping. The dish 26 comprises a dome 28 in which a dispensing valve 30 with emerging stem 32 is mounted. The free end of the stem 32 is engaged in a corresponding bore made in the lower end of the dispensing member 20. The dispensing member has a central dispensing duct 34 which ends opposite a solid portion 20*a* situated at the free end of the dispensing member 20. Just below the portion 20*a*, the central duct 34 opens to two radial ducts 22 arranged, in the position of rest, facing the internal wall of the annular shut-off device 18. The valve 30 is connected to a dip tube 36 which generally ends near the bottom of the reservoir 2.

As can be seen in FIG. 3, the dispensing member consists of four portions 20*b*, 20*c*, 20*d* and 20*e* of increasing diameter. The portion 20*b* has a diameter slightly smaller than the diameter of the solid portion 20*a*. Between the smallest-diameter portion 20*b* and the portion 20*c* there is a connecting region 20*f* in the shape of a cone frustum. The portion 20*c* is separated from the portion 20*d* by a step 20*g*. Likewise, between the portion 20*d* and the portion 20*e* there is a step 20*h*. One or more annular ribs 20*i* may be provided for centering the dispensing member 20 in the fitting 16 (see FIG. 4).

When the unit 1 is in the position of rest, the step 20*g* is arranged a small axial distance $\delta_c$ from a corresponding shoulder 16*a* made on the inside of the fitting 16, whereas, when the push-button 12 is actuated, this step 20*g* is able to come into abutment against the projection 16*a*. Typically, this distance $\delta_c$ is 0.8 mm to 1.0 mm. This axial distance $\delta_c$ allows the fitting 16 to move a short axial distance with respect to the dispensing member 20, as will be seen in detail later.

Figure 5:
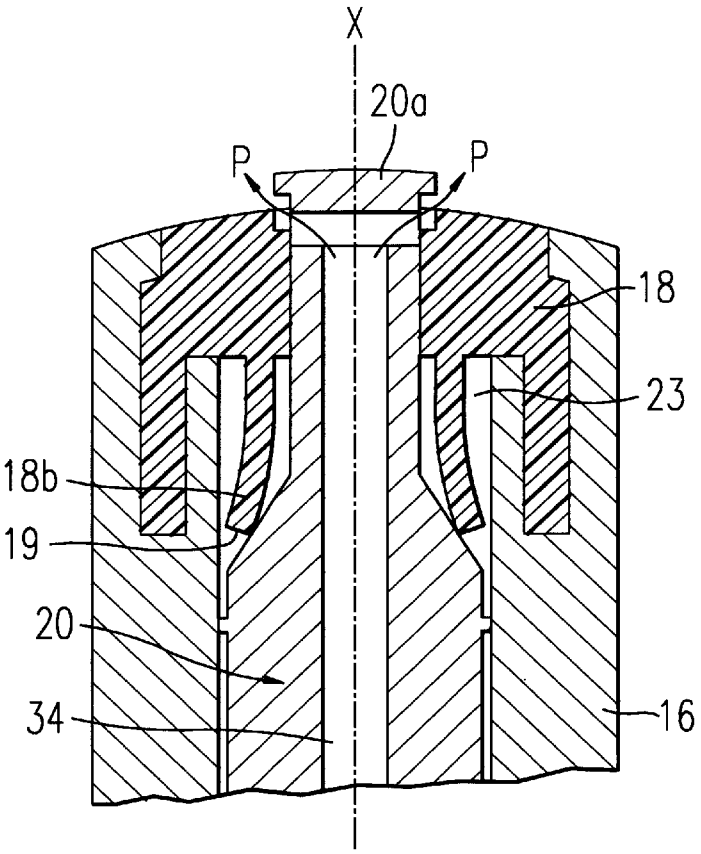
FIG. 5 depicts a view in longitudinal section of the shut-off device in the dispensing position.
Figure 4:
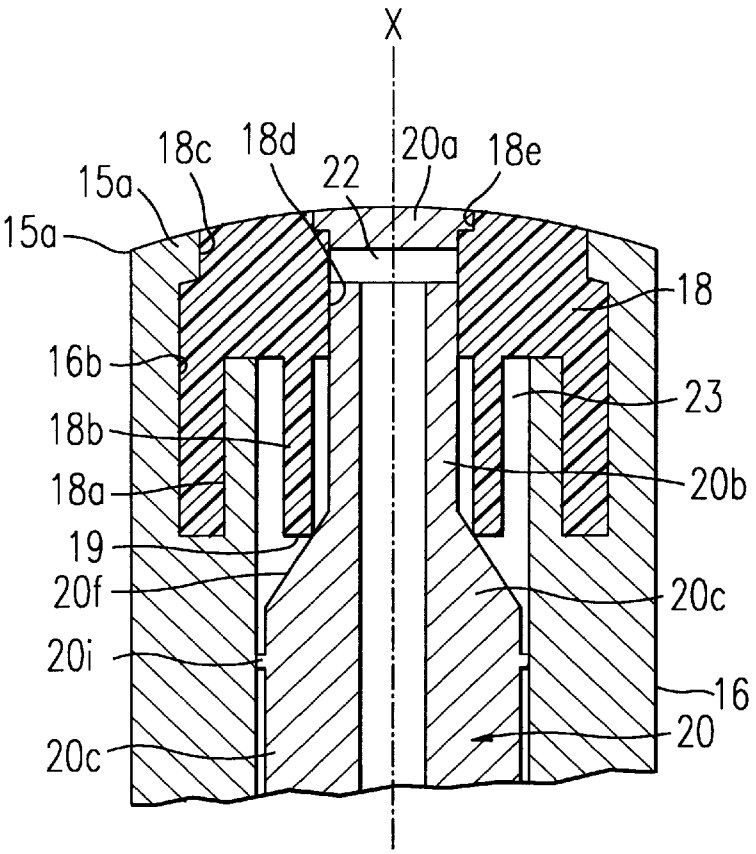
FIG. 4 shows an enlarged view in longitudinal section of the shut-off device in the position of rest.

Referring in particular to FIGS. 4 and 5, it can be seen that the annular shut-off device 18 has two cylindrical skirts 18*a* and 18*b* arranged concentrically and facing towards the reservoir. The first skirt 18*a*, of larger diameter than the second skirt 18*b*, is set into a housing 16*b* made in the wall of the fitting 16 near to its free end 15 and having a shape that complements the shape of the skirt 18*a*. The free end 15 has a rim 15*a* in contact with a smaller-diameter region 18*c* formed by the upper end of the shut-off device 18. This allows the shut-off device 18 to be blocked axially inside the fitting 16.

The second skirt 18*b* has a free end 19 resting elastically on the inclined surface of the cone frustum 20*f*. Note that between the external surface of the skirt 18*b* and the internal wall of the fitting 16 there is a space 23 to allow the free end 19 of the second skirt to deflect radially. This deflection allows the skirt 18*b* to be stressed.

The annular shut-off device 18 also has a cylindrical central passage 18*d* in which the smallest-diameter portion 20*b* of the dispensing member 20 is located. The central passage 18*d* has an end 18*e* of diameter slightly greater than the diameter of the rest of the passage 18*d*. Housed in this end 18*e*, in a position of rest, is the solid portion 20*a* of the dispensing member 20. With reference to FIG. 4, the shut-off device closes the dispensing duct 34 via the radial ducts 22. The second skirt 18*b* ensures a good seal between the dispensing member 20 and the internal wall of the fitting 16 pushing the dispensing member 20 elastically towards the reservoir 2 in response to a force exerted on the actuating surface 13. It also elastically returns the shut-off device 18 to cover the ducts 22.

Note that, advantageously, the shut-off device 18 may be installed during manufacture of the dispensing head 1 by a technique of two-shot injection molding of an elastomeric thermoplastic material (forming the shut-off device) and a rigid thermoplastic material (forming the push-button and the band in one single piece).

To dispense some product, the user presses on the actuating surface 13 in the direction of the arrow F (see FIG. 3). As shown in FIG. 5, the end 19 of the skirt 18*b* deforms, the fitting 16 moves downwards with respect to the dispensing member 20 over an axial distance $\delta_c$ and the ends 22 of the dispensing duct are uncovered. When the user continues to press, the shoulder 16*a* comes into abutment against the edge formed by the step 20*g*. By this operation, the dispensing member 20 is brought into a lower axial position suitable for actuating the dispensing valve. Some product P is then dispensed, as indicated by the arrows P in FIG. 5.

When the pressure on the actuating surface 13 is relaxed, the dispensing member 20 returns to the closed position under the effect of a return force exerted by the valve on which the valve stem is mounted.

The fitting 16 moves back upwards with the dispensing member 20. When the dispensing member 20 reaches the uppermost end of its travel, the fitting 16 continues its travel over a height $\delta_c$, under the effect of the elastic return force exerted by the skirt 18*b*, thus causing the shut-off device 18 to again cover the ducts 22. Thus, dispensing is halted abruptly and any belated flow of product is prevented. In particular, in the case of a highly-expanding product such as a foam or mousse or a self-foaming gel, the unit always remains clean.

Obviously, numerous modifications and variations of the present invention are possible in light of the above teachings. It is therefore to be understood that within the scope of the appended claims, the invention may be practiced otherwise than as specifically described herein.

What is claimed is:

1. A dispensing head for dispensing a product under pressure, comprising:

a dispensing member mountable on a pump or valve surmounting a reservoir containing the product and defining an outlet duct for the product, the outlet duct opening to at least one dispensing orifice;

a substantially rigid actuating fitting movable in response to a pressure exerted on the actuating fitting from a first position to a second position, the actuating fitting being configured to come into engagement with the dispensing member during the movement of the actuating fitting from the first position to the second position in order to move the dispensing member from a closed position to a dispensing position in which the outlet duct is in communication with the reservoir; and a shut-off device movable with the actuating fitting from the first position in which the dispensing orifice is closed thereby to a second position in which the dispensing orifice is uncovered to allow the product to exit under pressure, wherein said shut-off device is constructed to elastically return to the first position when the actuating pressure ceases.

2. The dispensing head according to claim 1, wherein a distance of said movement of said actuating fitting from the first position to the second position exceeds a distance of said movement of said dispensing member from the closed position to the dispensing position.

3. The dispensing head according to claim 2, wherein said dispensing member returns from the dispensing position to the closed position under the effect of a return force generated by the pump or valve.

4. The dispensing head according to claim 1, wherein the actuating fitting has an annular portion surrounding the dispensing member, and wherein a free end of the annular portion lies substantially adjacent the at least one dispensing orifice, said shut-off device having an annular member mounted inside the annular portion of the actuating fitting, said actuating fitting being mounted so that it can slide with respect to the dispensing member.

5. The dispensing head according to claim 4, wherein said actuating fitting and the said shut-off device are molded of a first and a second thermoplastic material which are physico-chemically compatible.

6. The dispensing head according to claim 5, wherein the first material consists of one of a polyethylene and a polypropylene, and wherein the second material is an elastomer chosen from the group consisting of ethylene/propylene copolymers; poly (ether-block-amide)s; polyvinyls; ethylene-propylene-diene terpolymers (EPDM); styrene-butadiene block copolymers (SBS); styrene-ethylene-butadiene block copolymers (SEBS-SIS); thermoplastic polyurethanes; blends of polypropylene with one of the following elastomers:styrene-ethylene-butadiene block copolymers (SEBS-SIS), ethylene-propylene-diene terpolymers (EPDM), and styrene-butadiene block copolymers (SBS).

7. The dispensing head according to claim 4, wherein said annular member defines a skirt having a free edge which, in the second position, provides sealing between the actuating fitting and the dispensing member.

8. The dispensing head according to claim 1, wherein the at least one outlet orifice opens at right angles to the outlet duct.

9. The dispensing head according to claim 1, further comprising a part integral with the actuating fitting which fixes the actuating fitting to the reservoir.

10. A dispensing head for dispensing a product under pressure, comprising;

a dispensing member mountable on a pump or valve surmounting a reservoir containing the product and defining an outlet duct for the product, the outlet duct opening to at least one dispensing orifice;

a substantially rigid actuating fitting movable in response to a pressure exerted on the actuating fitting from a first position to a second position, the actuating fitting being configured to come into engagement with the dispensing member during the movement of the actuating fitting from the first position to the second position in order to move the dispensing member from a closed position to a dispensing position in which the outlet duct is in communication with the reservoir; and a shut-off device movable with the actuating fitting from the first position in which the dispensing orifice is closed thereby to a second position in which the dispensing orifice is uncovered to allow the product to exit under pressure, wherein said shut-off device is constructed to elastically return to the first position when the actuating pressure ceases, wherein the shut-off device provides sealing between the dispensing member and the actuating fitting.

11. A unit for packaging a product under pressure, comprising:

a reservoir for a liquid product to be dispensed and fitted with a valve or a pump;

a dispensing member mountable on the pump or valve and defining an outlet duct for the product, the outlet duct opening to at least one dispensing orifice;

a substantially rigid actuating fitting movable in response to a pressure exerted on the actuating fitting from a first position to a second position, the actuating fitting being configured to come into engagement with the dispensing member during the movement of the actuating fitting from the first position to the second position in order to move the dispensing member from a closed position to a dispensing position in which the outlet duct is in communication with the reservoir; and a shut-off device movable with the actuating fitting from the first position in which the dispensing orifice is closed thereby to a second position in which the dispensing orifice is uncovered to allow the product to exit under pressure, wherein said shut-off device is constructed to elastically return to the first position when the actuating pressure ceases.

12. The unit according to claim 11, wherein the valve has an emerging stem in communication with the dispensing member, the product contained in the reservoir being pressurized by a propellant gas.

13. The unit according to claim 11, wherein the product comprises a self-foaming gel, a foam or mousse, or a hair-coloring product.

14. A unit for packaging a product under pressure, comprising:

a reservoir for a liquid product to be dispensed and fitted with a valve or a pump;

a dispensing member mountable on the pump or valve and defining an outlet duct for the product, the outlet duct opening to at least one dispensing orifice;

a substantially rigid actuating fitting movable in response to a pressure exerted on the actuating fitting from a first position to a second position, the actuating fitting being configured to come into engagement with the dispensing member during the movement of the actuating fitting from the first position to the second position in order to move the dispensing member from a closed position to a dispensing position in which the outlet duct is in communication with the reservoir; and a shut-off device movable with the actuating fitting from the first position in which the dispensing orifice is closed thereby to a second position in which the dispensing orifice is uncovered to allow the product to exit under pressure, wherein said shut-off device is constructed to elastically return to the first position when the actuating pressure ceases, wherein the shut-off device provides sealing between the dispensing member and the actuating fitting.

* * * * *